US007290661B1

(12) United States Patent
DeFino

(10) Patent No.: US 7,290,661 B1
(45) Date of Patent: Nov. 6, 2007

(54) CUTLERY TRAY WITH ROLL-TOP CLOSURE

(76) Inventor: Richard DeFino, 4 Woodlot Rd., apt. 4, Eastchester, NY (US) 10709

( * ) Notice: Subject to any disclaimer, the term of this patent is extended or adjusted under 35 U.S.C. 154(b) by 256 days.

(21) Appl. No.: 11/131,513

(22) Filed: May 17, 2005

Related U.S. Application Data

(60) Provisional application No. 60/521,906, filed on Jul. 19, 2004.

(51) Int. Cl.
*B65D 1/34* (2006.01)

(52) U.S. Cl. ..... 206/553; 30/298.4; 220/252; 312/307

(58) Field of Classification Search ..... 206/349, 206/553; 30/1, 298.4; 211/60.1, 70.7; 220/252, 220/345.1, 348, 259.5, 288; 312/330.1, 348.3, 312/307

See application file for complete search history.

(56) References Cited

U.S. PATENT DOCUMENTS 2,035,830 A * 3/1936 Parkin ..... 220/259.5
2,099,122 A * 11/1937 Kreisler ..... 220/259.5
2,555,705 A * 6/1951 Schafer ..... 220/348
3,343,709 A * 9/1967 Henderson ..... 220/259.5
4,756,581 A * 7/1988 Phillips ..... 312/348.3
4,979,610 A * 12/1990 Thomas ..... 206/553

* cited by examiner

*Primary Examiner*—Luan K Bui
(74) *Attorney, Agent, or Firm*—Andrew Wilford

(57) ABSTRACT

Apparatus 10 discloses a cutlery receptacle comprising a housing 13 having a roll-top cover 20 movable between an open 14 and closed 16 position with mating members 22, 32 of a locking mechanism incorporated respectively in the housing 22 and cover 32. Additionally incorporated into the interior opposing sides 28, 30 of the housing 13 is a continuous track 24, 26 extending between the top front and bottom front of the receptacle 10 encompassing the left and right sides 28, 30 of the roll-top cover 20 sealing the interior of the cutlery receptacle from dirt, debris, insects and vermin. Once opened the roll-top cover 20 provides access to various shaped cavities 34 for receiving myriad types of cutlery, such as forks 42, teaspoons 44, tablespoons 46, steak knives 40, butter knives 48 and a general storage 50 compartment.

14 Claims, 7 Drawing Sheets

CUTLERY TRAY WITH ROLL-TOP CLOSURE

RELATED APPLICATIONS

This application is subject to U.S. provisional application Ser. No. 60/521,906 filed 19 Jul. 2004.

Please incorporate by reference all information in said provisional application into this instant application.

BACKGROUND OF THE INVENTION

1. Field of the Invention

The present invention relates generally to receptacles and, more specifically, to a cutlery receptacle comprising a housing having a roll-top cover movable between an open an closed position with mating members of a locking mechanism incorporated respectively in the housing and cover. Additionally incorporated into the interior opposing sides of the housing is a continuous track extending between the top front and bottom front of the receptacle encompassing the left and right sides of the roll-top cover sealing the interior of the cutlery receptacle from dirt, debris, insects and vermin. Once opened the roll-top cover provides access to various shaped cavities for receiving myriad types of cutlery, such as forks, teaspoons, tablespoons, steak knives, butter knives and a general storage compartment.

2. Description of the Prior Art

There are other protective devices designed for protecting the contents therein.

While these devices may be suitable for the purposes for which they where designed, they would not be as suitable for the purposes of the present invention as heretofore described.

It is thus desirable to provide a receptacle for the storage of cutlery to prevent contamination thereof.

It is further desirable to provide said receptacle with means of closure incorporating a locking mechanism to prevent access thereto.

SUMMARY OF THE PRESENT INVENTION

The present invention discloses a cutlery receptacle comprising a housing having a roll-top cover movable between an open and closed position with mating members of a locking mechanism incorporated respectively in the housing and cover. Additionally incorporated into the interior opposing sides of the housing is a continuous track extending between the top front and bottom front of the receptacle encompassing the left and right sides of the roll-top cover sealing the interior of the cutlery receptacle from dirt, debris, insects and vermin. Once opened the roll-top cover provides access to various shaped cavities for receiving myriad types of cutlery, such as forks, teaspoons, tablespoons, steak knives, butter knives and a general storage compartment.

A primary object of the present invention is to provide a protective receptacle for cutlery.

Another object of the present invention is to provide a cutlery receptacle having a housing with means for closure.

Yet another object of the present invention is to provide a cutlery receptacle having a roll-top cover forming means for closure.

Still yet another object of the present invention is to provide a cutlery receptacle with an interior continuous track on opposing sides extending from the top front to the bottom front forming means for engaging the roll-top cover.

Another object of the present invention is to provide a cutlery receptacle having a roll-top cover incorporating a tensioning member to aid in opening said roll-top cover.

Yet another object of the present invention is to provide a cutlery receptacle having a roll-top cover wherein said tensioning member is a spring fastened between the back-end of the roll-top cover and the terminus of the roll-top track.

Still yet another object of the present invention is to provide a cutlery receptacle having a locking mechanism incorporated into said housing with mating locking elements within the roll-top cover.

Another object of the present invention is to provide the interior of the cutlery receptacle with a plurality of predetermined formed cavities providing means for receiving various types of cutlery.

Additional objects of the present invention will appear as the description proceeds.

The present invention overcomes the shortcomings of the prior art by providing a cutlery receptacle comprising a housing having a roll-top cover movable between an open an closed position with mating members of a locking mechanism incorporated respectively in the housing and cover. Additionally incorporated into the interior opposing sides of the housing is a continuous track extending between the top front and bottom front of the receptacle encompassing the left and right sides of the roll-top cover sealing the interior of the cutlery receptacle from dirt, debris, insects and vermin. Once opened the roll-top cover provides access to various shaped cavities for receiving myriad types of cutlery, such as forks, teaspoons, tablespoons, steak knives, butter knives and a general storage compartment.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
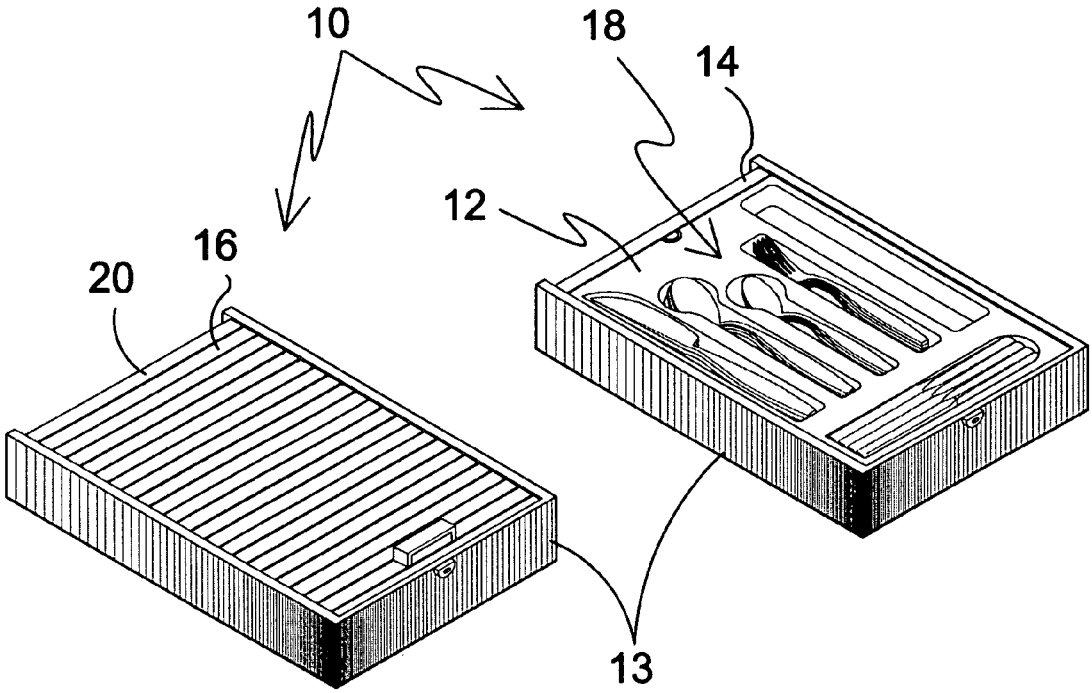
FIG. 1 is an illustrative chart of the present invention.

With regard to reference numerals used, the following numbering is used throughout the drawings.

10 present invention
12 tray
13 housing
14 open position
16 closed position
18 cutlery
20 roll-top door
22 housing locking mechanism
24 upper track
26 lower track
28 one side
30 opposite side
32 door locking mechanism
34 cavity
36 spring
38 terminus
40 steak knife compartment
42 fork compartment
44 teaspoon compartment
46 tablespoon compartment
48 butter knife compartment
50 general storage compartment

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative chart of the present invention 10. Shown is the cutlery tray 12 of the present invention 10 in an open 14 and closed 16 position providing means to ensure that the contents of cutlery 18 are protected from vermin, insect and dirt once the roll-top door 20 is closed.

Figure 2:
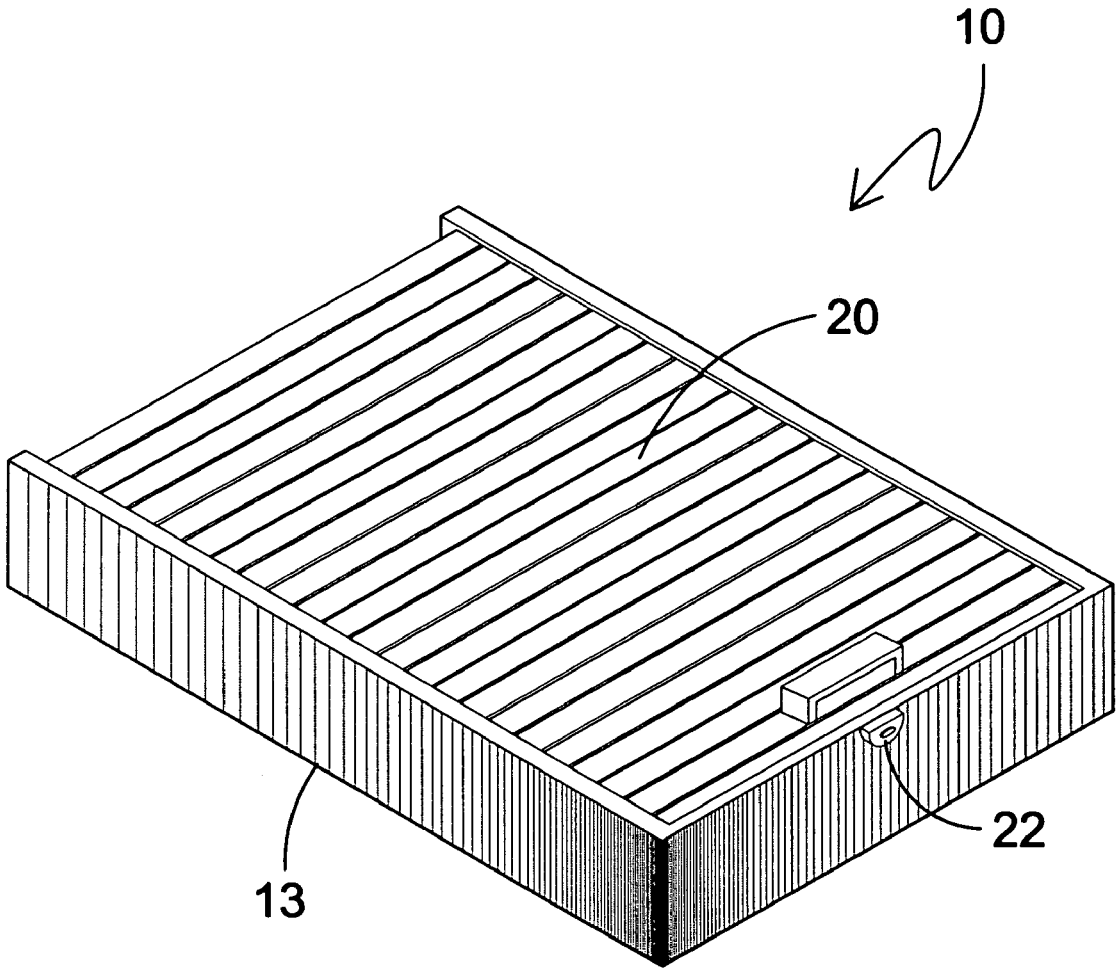
FIG. 2 is a perspective view of the present invention in a closed position.

Turning to FIG. 2, shown therein is a perspective view of the present invention 10 in a closed position. The present invention comprises a receptacle 12 in housing 13 having a roll-top door 20 to prevent the entry of dirt, debris, insects and vermin. The present invention 10 also provides a locking mechanism 22 to prevent access thereto even by determined vermin and insects.

Figure 3:
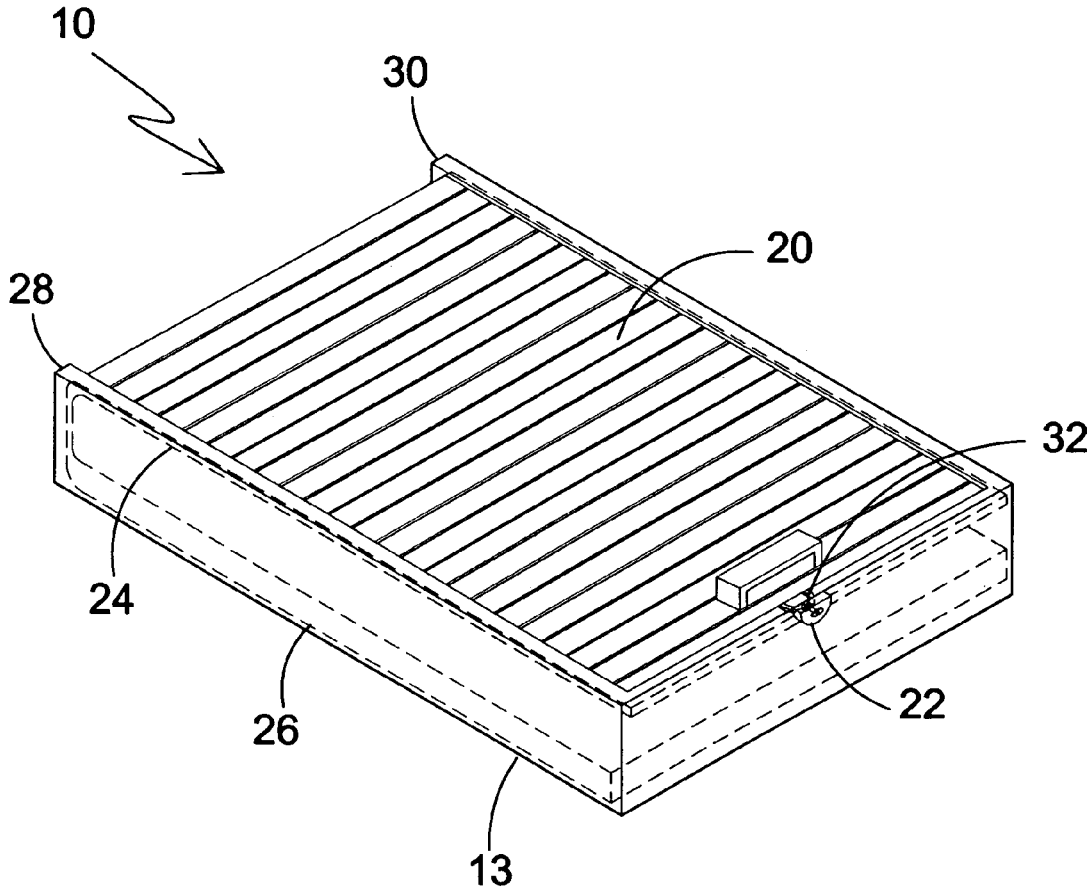
FIG. 3 is a perspective view of the present invention in a closed position.

Turning to FIG. 3, shown therein is a perspective view of the present invention 10 in a closed position. Shown is the present invention 10 comprising a receptacle in a housing 13 having a roll-top cover 20 to protect the contents therein. As illustrated, the roll-top cover 20 moves within an upper 24 and lower 26 track positioned on opposing sides 28, 30 of the receptacle 12. Also shown are mating portions on housing 22 and on door 32 of a locking mechanism for the door 20.

Figure 4:
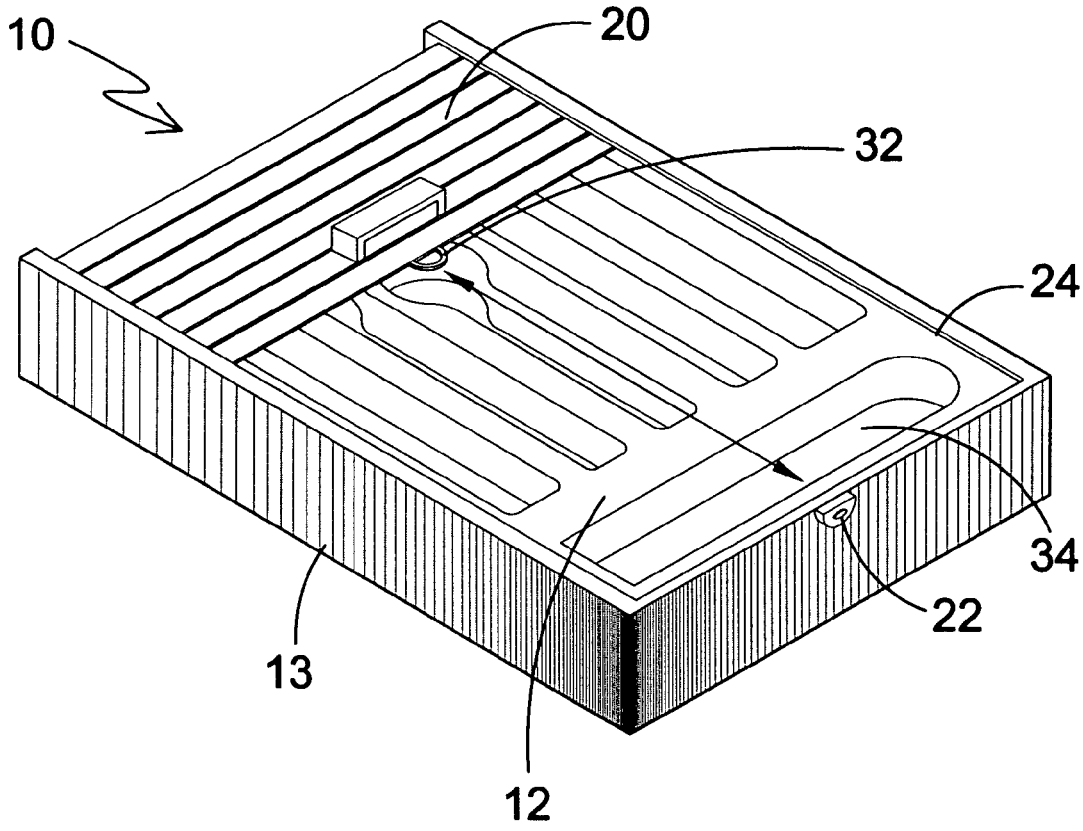
FIG. 4 is a perspective view of the present invention in a partially open position.

Turning to FIG. 4, shown therein is a perspective view of the present invention 10 in a partially open position. Depicted is the cutlery receptacle 12 comprising a housing 13 with a roll-top cover 20 that when moved to its open position provides access to various shaped cavities 34 for receiving myriad types of cutlery. Other previously disclosed elements are also shown.

Figure 5:
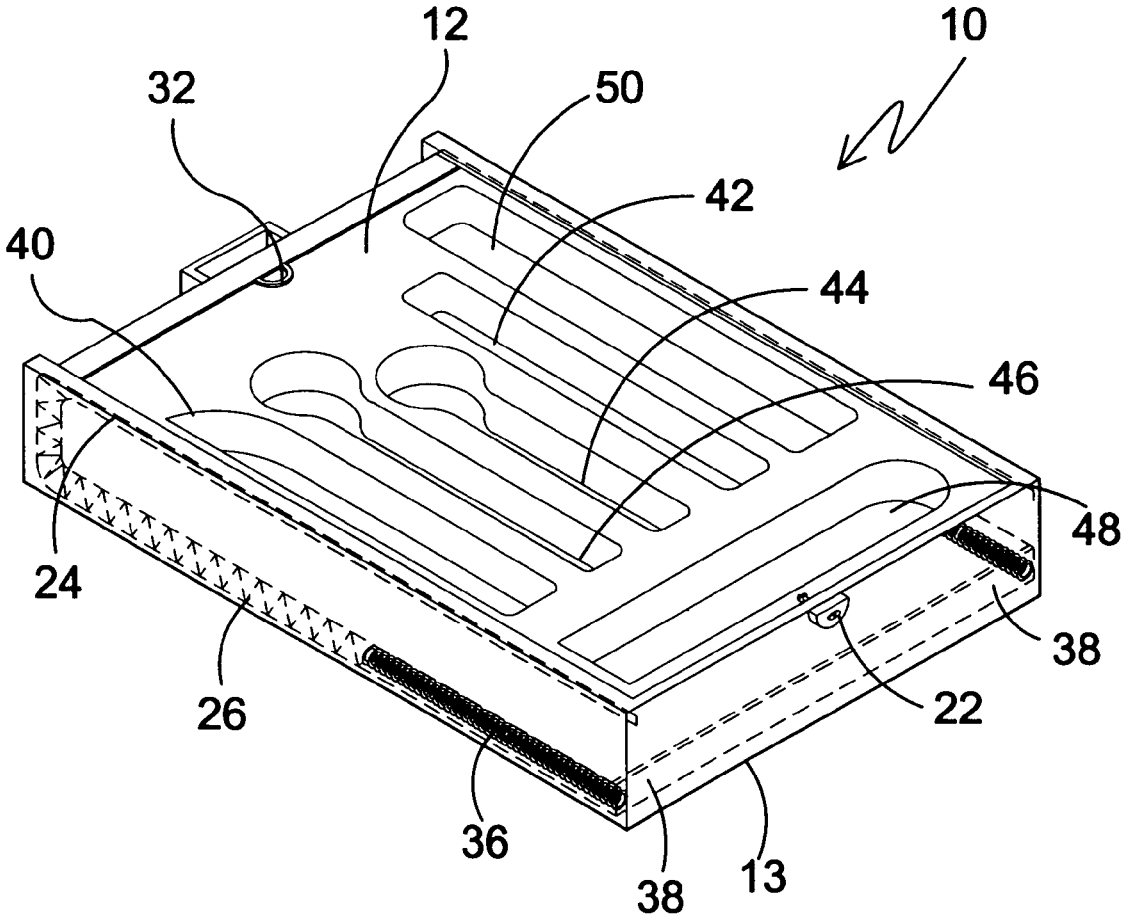
FIG. 5 is a perspective view of the present invention in an open position.

Turning to FIG. 5, shown therein is a perspective view of the present invention 10 in an open position. As illustrated the present invention 10 comprises a receptacle 12 having a roll-top door to prevent the entry of dirt, debris, insects and vermin. Shown is the roll-top cover in the open position having a spring 36 fixed between the back-end of the roll-top cover and terminus 38 of the roll-top track 26 to aid in the opening and closing of the cover. Track 26 is disposed on the inner surface of each of the first and second sides extending from the top front to the top rear end, then to the bottom rear end, and then to the bottom front of each of the first and second sides thereby forming upper and lower tracks. When closed the locking mechanism 22, 32 prevents access to the contents. Also shown are compartments for a steak knife 40, fork 42, teaspoon 44, tablespoon 46, butter knife 48, general storage 50 along with other previously disclosed elements.

Figure 6:
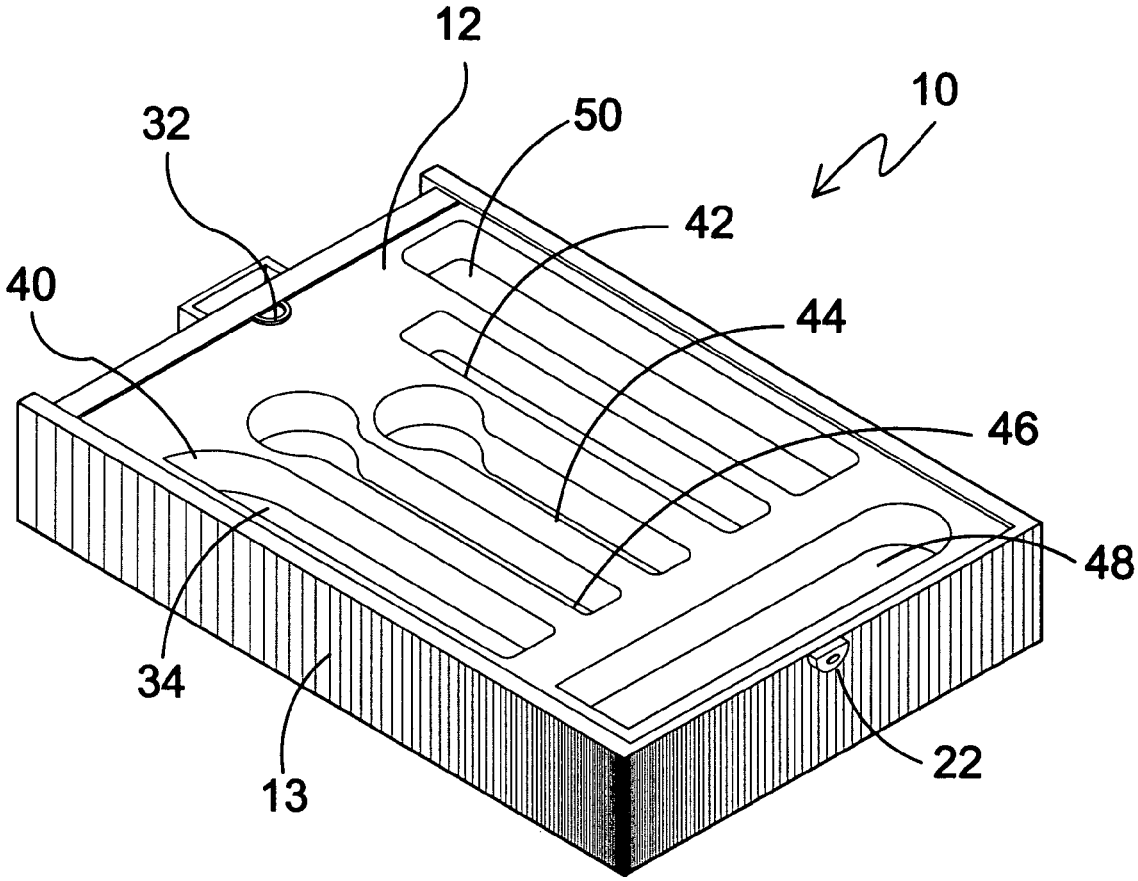
FIG. 6 is a perspective view of the present invention in an open position without utensils.

Turning to FIG. 6, shown therein is a perspective view of the present invention 10 in an open position without utensils. Depicted is the cutlery receptacle 10 comprising a housing 13 with a roll-top cover that when moved to its open position provides access to various shaped cavities 34 for receiving myriad types of cutlery, such as forks 42, teaspoons 44, tablespoons 46, steak knives 40, butter knives 48 and a general storage 50 compartment. Other previously disclosed elements are also shown.

Figure 7:
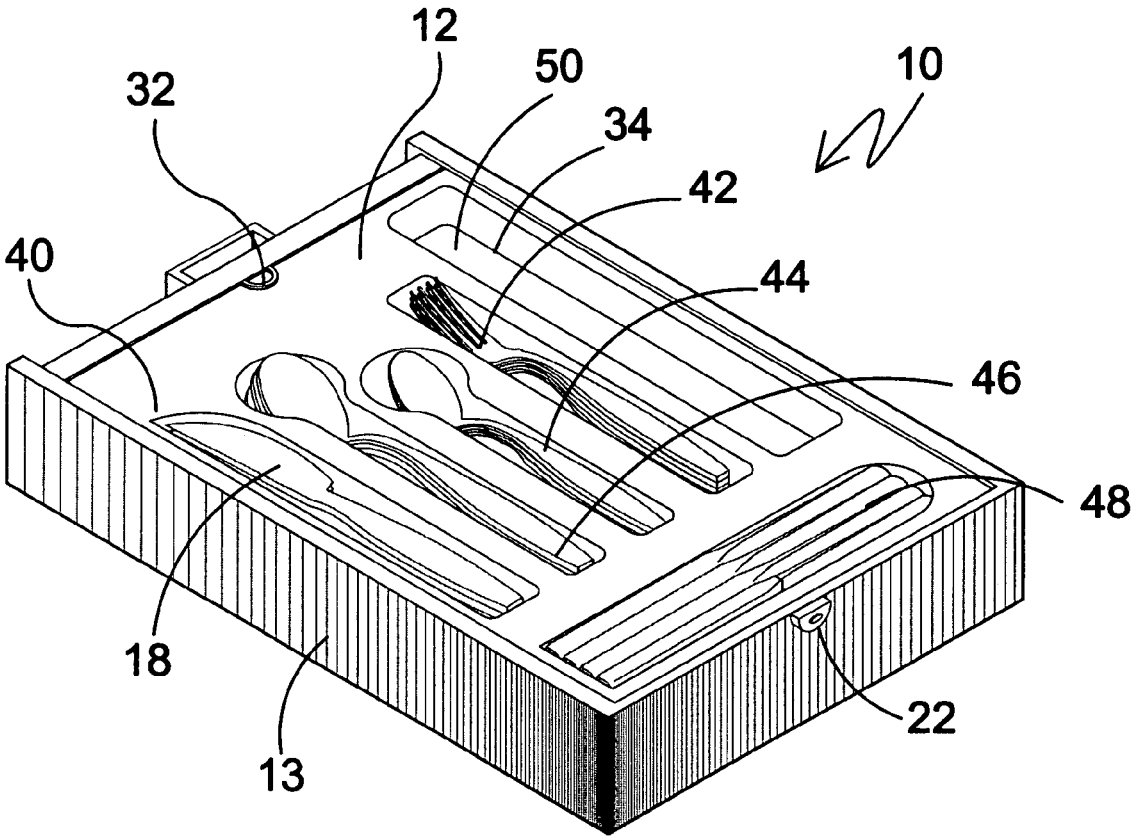
FIG. 7 is a perspective view of the present invention in an open position with cutlery within.

Turning to FIG. 7, shown therein is a perspective view of the present invention 10 in an open position with cutlery 18 within. As illustrated, the cutlery receptacle 10 comprises a housing 13 with a roll-top cover that when moved to its open position provides access to various shaped cavities 34 for receiving myriad types of cutlery, such as forks 42, teaspoons 44, tablespoons 46, steak knives 40, butter knives 48 and a general storage 50 compartment. Other previously disclosed elements are also shown.

I claim:

1. An apparatus for storing cutlery, the apparatus comprising:

a) a housing having front wall and rear end, first and second side walls, a top, and a bottom wall defining an interior, said front wall and said first and second side walls each having an inner surface, b) a respective track on said inner surface of each of said first and second side walls having an upper track portion extending along said top from the front wall to said rear end, a rear track portion extending thence to said bottom wall, and a lower track portion extending thence along said bottom wall to the front wall;

c) a roll-top cover having front and rear ends, on said housing, and movable in said track from a first position where said top of said housing is covered to a second position where said top of said housing is open, said roll-top cover upwardly closing said interior of said housing to permit the interior to remain sanitary when said cover is in said first position;

d) a tensioner in said track and biasing said roll-top cover toward said first position; and e) a tray in said interior of said housing and having front, rear, and side walls adjacent the respective front, rear, and side walls of the housing and formed with an array of cavities for receiving cutlery.

2. The apparatus of claim 1, further comprising a lock for securing said roll-top cover in said first position.

3. The apparatus of claim 1, wherein said cavities have a plurality of different shapes for receiving variously shaped pieces of cutlery.

4. The apparatus of claim 1, wherein said tensioner comprises a spring in said track.

5. The apparatus of claim 4, wherein said spring is disposed in a front end of said lower track portion at said front wall of said housing so that said spring contacts said rear end of said roll-top cover.

6. The apparatus of claim 5, wherein said lock comprises a first portion disposed on said roll-top cover and a second portion disposed on said front wall of said housing.

7. The apparatus of claim 6, wherein one of said cavities has the shape of a steak knife.

8. The apparatus of claim 6, wherein one of said cavities has the shape of a fork.

9. The apparatus of claim 6, wherein one of said cavities has the shape of a teaspoon.

10. The apparatus of claim 6, wherein one of said cavities has the shape of a tablespoon.

11. The apparatus of claim 6, wherein one of said cavities has the shape of a butter knife.

12. The apparatus of claim 6, wherein said front end of said roll-top cover is adjacent said front wall of said housing when said cover is in said first position.

13. The apparatus of claim 12, wherein said rear end of said roll-top cover is adjacent said front wall of said housing when said cover is in said second position.

14. The apparatus of claim 1 wherein the inner surfaces of the side walls are parallel and the tracks are each U-shaped and their upper and lower portions vertically flank the tray.

* * * * *